US010562544B2

(12) United States Patent
Kammerloher et al.

(10) Patent No.: US 10,562,544 B2
(45) Date of Patent: Feb. 18, 2020

(54) RAIL VEHICLE

(71) Applicant: SIEMENS MOBILITY GMBH, Munich (DE)

(72) Inventors: Herbert Kammerloher, Biburg (DE); Thomas Langenbacher, Mering (DE)

(73) Assignee: Siemens Mobility GmbH, Munich (DE)

( * ) Notice: Subject to any disclaimer, the term of this patent is extended or adjusted under 35 U.S.C. 154(b) by 349 days.

(21) Appl. No.: 15/323,621

(22) PCT Filed: Jun. 25, 2015

(86) PCT No.: PCT/EP2015/064368
§ 371 (c)(1),
(2) Date: Jan. 3, 2017

(87) PCT Pub. No.: WO2016/001056
PCT Pub. Date: Jan. 7, 2016

(65) Prior Publication Data

US 2017/0129507 A1 May 11, 2017

(30) Foreign Application Priority Data

Jul. 3, 2014 (DE) ..... 10 2014 212 945

(51) Int. Cl.
*B61D 17/06* (2006.01)
*B61D 17/02* (2006.01)
*B61D 49/00* (2006.01)

(52) U.S. Cl.
CPC ..... *B61D 17/02* (2013.01); *B61D 17/06* (2013.01); *B61D 49/00* (2013.01)

(58) Field of Classification Search
CPC ..... B61D 17/02; B61D 17/06; B61D 49/00
USPC ..... 105/402, 261.2, 1.3; 296/136.1, 135, 296/136, 136.01
See application file for complete search history.

(56) References Cited

U.S. PATENT DOCUMENTS 2,907,384 A * 10/1959 Spratt ..... B60J 11/08 160/370.21
3,869,332 A * 3/1975 Loew ..... B60R 13/04 156/63
6,217,958 B1 * 4/2001 Blyden ..... B32B 27/30 428/31
6,595,575 B2 * 7/2003 Morris ..... B60R 13/04 280/770
6,852,385 B2 * 2/2005 Rattigan ..... G09F 5/00 428/542.2
6,941,874 B2 9/2005 Huss et al.
7,222,562 B2 * 5/2007 Smiley ..... F41H 7/04 296/136.02

(Continued)

FOREIGN PATENT DOCUMENTS

CN 1368448 A 9/2002
CN 200939886 Y 8/2007

(Continued)

*Primary Examiner* — Scott A Browne
(74) *Attorney, Agent, or Firm* — Laurence Greenberg Werner Stemer; Ralph Locher

(57) ABSTRACT

A rail vehicle includes a device compartment for accommodating a device, a protective flap for protecting the device compartment, and a decorative flap at least partially hiding or covering the protective flap. The decorative flap has a lower degree of rigidity or stiffness than the protective flap.

9 Claims, 1 Drawing Sheet

(56) References Cited

U.S. PATENT DOCUMENTS

| | | | | |
|---|---|---|---|---|
| 8,757,066 | B2 | 6/2014 | Heinisch et al. | |
| 2002/0073887 | A1 | 6/2002 | Godin et al. | |
| 2009/0058109 | A1 | 3/2009 | Mattschull | |
| 2010/0326316 | A1* | 12/2010 | Iden | B61D 17/02 105/1.1 |
| 2014/0360402 | A1* | 12/2014 | Koudolo | B61D 15/06 105/392.5 |
| 2018/0290529 | A1* | 10/2018 | Ching | B60J 11/04 |

FOREIGN PATENT DOCUMENTS

| | | | | |
|---|---|---|---|---|
| DE | 4445182 | C1 | 12/1995 | |
| DE | 29706073 | U1 | 7/1997 | |
| DE | 202012101220 | U1 | 4/2012 | |
| EP | 1366965 | A1 | 12/2003 | |
| EP | 1958848 | A1 | 8/2008 | |
| EP | 2208655 | A1 | 7/2010 | |
| EP | 2623390 | A1 | 8/2013 | |
| EP | 2208655 | B1 * | 3/2014 | B61D 17/06 |
| RU | 69475 | U1 | 12/2007 | |
| WO | 2011154527 | A1 | 12/2011 | |

* cited by examiner

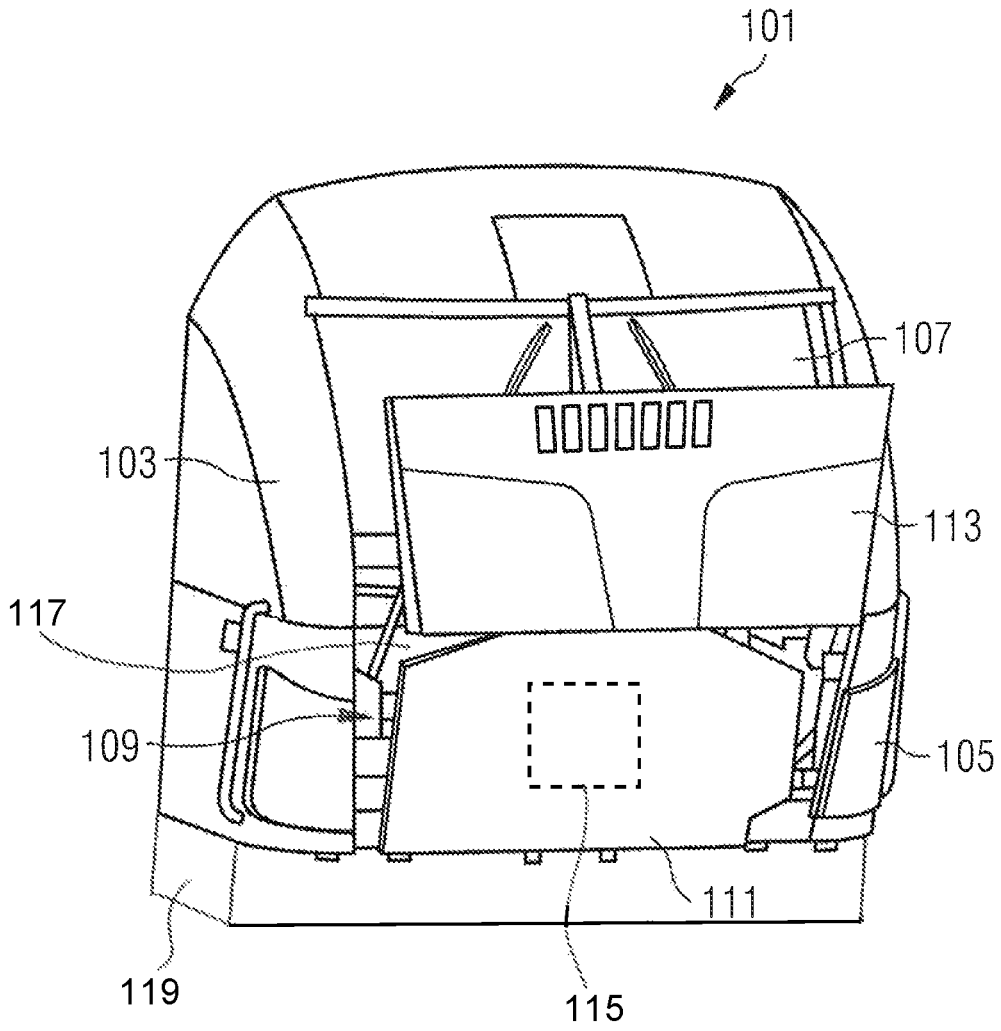
101
107
103
113
117
109
105
111
119
115

RAIL VEHICLE

BACKGROUND OF THE INVENTION

Field of the Invention

Rail vehicles generally comprise one or more device compartments, for example a front compartment in which devices, for example an air-conditioning system, can be accommodated. It is expedient to protect such device compartments from external influences, so that the devices accommodated are not damaged.

It is known in the case of front compartments for a lower front to be either permanently welded to a car body. This results in high to very high repair costs and downtimes even in the case of scenarios in which the damage is minor to moderate.

It is also known in the case of a front compartment for the lower front to be provided with a front flap, with the help of which more minor damage can be eliminated simply and quickly by replacing the front flap. However, account must be taken here of costly damage to the devices behind the front flap, since the latter provides only moderate resistance.

BRIEF SUMMARY OF THE INVENTION

The object underlying the invention can thus be seen as providing a rail vehicle comprising a device compartment for accommodating a device, wherein an accommodated device is protected against external influences and any repair costs which are necessary are reduced.

This object is achieved by the subject matter described below. Advantageous embodiments of the invention form the subject matter of dependent sub claims.

According to one aspect a rail vehicle is provided, comprising:

- a device compartment for accommodating a device,
- a protective flap for protecting the device compartment,
- a decorative flap at least partially hiding the protective flap,
- wherein the decorative flap has a lower degree of rigidity than the protective flap.

The invention therefore in particular comprises the idea of providing two elements—the protective flap and the decorative flap—each of which has or effects a separate function. One of the elements fulfills a protective function: the protective flap. The other element fulfills a design function: the decorative flap. The decorative flap therefore no longer itself needs to fulfill a protective function. Hence it no longer needs to have a rigidity appropriate to a protective function. Hence it also has a lower degree of rigidity than the protective flap. Thus the decorative flap can be manufactured at a lower cost than the protective flap. In contrast, the protective flap can be optimized to satisfy a protective function, without hereby having to make compromises as regards an attractive design. This is because the protective flap is at least partially hidden by the design flap, and is therefore at least partially no longer visible to an observer who is looking at the design flap.

Because of the optimization undertaken as regards protection, the device compartment and thus the device or devices located in the device compartment are optimally protected against external influences, for example an accident, in particular an accident involving wildlife, a collision or a rockfall. The invention therefore moves away from an engineer's customary procedure, in which efforts are concentrated on realizing as many functions as possible in one common element. According to the invention, two separate elements are provided here for the two functions of protection and design. By splitting functions between two components it is thus advantageously possible to optimize the decorative flap, which can also be called a design flap, in terms of design and replacement costs, as it were as a "disposable part". Normally the decorative flap is damaged in almost every collision. The protective flap, which can also be called an impact shield, can be optimized as regards the protective function, and so generally at least up to a moderate level of damage need be repaired either simply and crudely, but not in terms of appearance or design, or, in the case of smaller dents, need not be repaired at all.

According to one embodiment a device is accommodated in the device compartment. Preferably a plurality of devices is accommodated. The devices are for example formed identically or differently.

According to one embodiment the device is an air-conditioning device.

The general wording that the protective flap and/or the decorative flap are arranged or mounted means in particular that the flaps are arranged or mounted on elements of the rail vehicle which are not all explicitly listed here. Such elements can for example be elements of the body of the rail vehicle. This means that the two flaps are preferably arranged or mounted on the body.

According to one embodiment it is provided that the decorative flap completely hides the protective flap. This means that the protective flap is completely hidden by the decorative flap. As a result, a particularly attractive appearance is advantageously brought about.

The fact that the decorative flap at least partially hides the protective flap, in particular completely hides it, means in particular that the decorative flap at least partially, in particular completely, hides one side of the protective flap which faces away from the device compartment.

According to one embodiment it is provided that at least either the protective flap or the decorative flap is movably mounted. This means that either the protective flap or the decorative flap or both the protective flap and the decorative flap are movably mounted. This means that the flaps can advantageously be moved. This advantageously brings about in particular greater ease of access to the device compartment and/or to the protective flap in the event that the decorative flap is movably arranged.

In another embodiment it is provided that the at least one movably mounted flap can be mounted so as to pivot and/or rotate and/or lift out. This means that either the protective flap or the decorative flap or both the protective flap and the decorative flap are mounted so as to pivot and/or rotate and/or lift out. Advantageously preferred options of a movable mounting are specified. Thus multiple degrees of freedom are provided. Depending on the specific application, the optimally appropriate mounting option can be chosen. The more degrees of freedom that are provided, the simpler it advantageously is to move the flap (the protective flap and/or the decorative flap) into various positions even in different environments, in order to give access to the device or devices in the device compartment or to give access to the protective flap.

The fact that at least one of the two flaps, in particular both flaps, are movably mounted means in particular that the flap can be displaced or moved from a first position into a second position. Thus for example the protective flap can be displaced or moved from a closed position into an open position and vice versa. In the open position access to the device in the interior of the device compartment is enabled.

The device compartment is in this respect open. In the closed position no access to the device in the device compartment is enabled. The device compartment is closed in this respect, preferably at least partially closed. The decorative flap can for example be moved or displaced from a position at least partially hiding the protective flap, in particular a position completely hiding it, into a position exposing the protective flap, in which although the decorative flap no longer hides the protective flap at least partially, in particular completely, access to the protective flap is however enabled. This is particularly advantageous if the protective flap needs to be checked for damage.

It should be noted that according to one embodiment the decorative flap need not necessarily be a flap with its own movement apparatus. This is because according to one embodiment the decorative flap is arranged or attached, in particularly removably arranged or attached, preferably non-destructively removably arranged or attached, on the protective flap. Attaching the decorative flap to the protective flap is thus in particular technically expedient so long as the assembly and disassembly of the disposable element (decorative flap) is in line with the concept of "quick and inexpensive repair" and the requirement for "quick and easy accessibility of the devices in the device compartment". If the decorative flap is arranged on or attached to the protective flap a separate movement apparatus (in other words a separate displacement device) for the decorative flap can be dispensed with, in particular if the protective flap is itself movably mounted. This reduces the cost of materials and of installation and further reduces costs.

According to one embodiment the decorative flap is arranged or attached by means of a screwed joint (in other words by means of one or more screws) and/or by means of a hook-and-loop fastener (and/or by means of a plurality of hook-and-loop fasteners) and/or by means of a magnet (and/or by means of a plurality of magnets) and/or by means of adhesive on the protective flap and/or by means of a quarter-turn quick release (and/or by means of a plurality of quarter-turn quick releases) and/or by means of a Snaploc release (and/or by means of a plurality of Snaploc releases). This for example creates the technical advantage that the decorative flap can be easily detached from the protective flap (in particular if a suitable adhesive is chosen). This cuts repair time. The aforementioned attachment options or arrangement options for the decorative flap on the protective flap are merely options given by way of example, but are in no case restrictive. Other attachment means or attachment options are also conceivable and preferably provided and are known in particular to the person skilled in the art. The aforementioned attachment means are therefore to be understood as examples, but not as comprehensive.

According to a further embodiment it is provided that at least either the protective flap or the decorative flap is detachably arranged. This means that either the protective flap or the decorative flap or both the protective flap and the decorative flap are detachably arranged. In the event of damage the damaged flap can simply be replaced, without having to replace any other parts of the rail vehicle at the same time. This saves on installation time and costs. According to one embodiment a non-destructive detachable arrangement is provided. This means that the protective flap and/or the decorative flap are detachably arranged.

According to another embodiment it is provided that the rail vehicle comprises an exterior which is formed at least partially, preferably completely, by the decorative flap which is in a condition at least partially covering the protective flap, in particular in a condition completely covering it. This means that the decorative flap is visible from the outside and thus fulfills yet another function: forming part of the exterior. Thus the decorative flap is advantageously being used efficiently. Furthermore, because of the design function of the decorative flap an attractive optical exterior of the rail vehicle is brought about.

In another embodiment it is provided that the rail vehicle comprises a front side, wherein the exterior is the front side. The front side is particularly vulnerable to damage caused by external influences, for example by the aforementioned influences. Hence it is particularly expedient here to split the functions of protection and design. This is because generally an element which protects the device compartment and at the same time is part of the front side has to be replaced particularly frequently here. This is how it was done in the prior art. The resulting disadvantages are in particular long repair times and high costs. Because of the inventive provision of two elements (protective and decorative flap) it is generally sufficient to replace only the decorative flap. Even should the protective flap be visibly damaged after an accident or collision, this is not relevant, since the decorative flap hides this visible damage. So long as the protective flap can still fulfill its protective function, it need not be replaced. As a result repair times and thus associated downtimes of the rail vehicle can be reduced. Furthermore, costs are advantageously saved in this way.

In another embodiment it is provided that the rail vehicle comprises an anti-penetration wall, an underframe and a front window formed above the underframe, wherein the device compartment is a front compartment which is arranged above the underframe, underneath the front window and between the front side and the anti-penetration wall. As a result, protection of the front compartment is advantageously brought about. The latter is generally particularly vulnerable in the event of an accident or a collision. Since an air-conditioning device is normally arranged in the front compartment, this can be well protected. The protective flap thus closes at least partially, in particular completely, an opening in the front compartment which faces the front side.

In another embodiment it is provided that the device compartment is a front compartment.

According to another embodiment it is provided that the rail vehicle is a multiple unit or a locomotive.

BRIEF DESCRIPTION OF THE SEVERAL VIEWS OF THE DRAWING

The above-described properties, features and advantages of this invention and the manner in which these are achieved will now be described in greater detail more clearly and explicitly in the context of the following description of the exemplary embodiments, and by reference to the drawing, whereby The figure shows a section of a front region of a rail vehicle.

DESCRIPTION OF THE INVENTION

The figure shows a rail vehicle 101 in a sectional partial view obliquely from the front. A front region 103 of the rail vehicle 101 can be seen. The front region 103 has a front side 105. A front window 107 is provided in an upper region of the front region 103. A front compartment 109 is formed underneath the front window 107. The rail vehicle 101 further comprises an anti-penetration wall 117 and an underframe 119. The front compartment 109 is arranged above the underframe 119, underneath the front window 107 and between the front side 105 and the anti-penetration wall 117. A device 115, for example an air-conditioning device, can be accommodated in the front compartment 109. In particular a plurality of devices can be accommodated.

A protective flap 111 is provided, which protects the front compartment 109. This is so in particular in the case of a collision or accident. The protective flap 111 at least partially closes an opening in the front compartment 109 which faces the front side 105. The protective flap 111 closes the front compartment 109 at least partially, for example completely, in a first position, which can also be called a protective position.

According to one embodiment (not shown) it is provided that the protective flap 111 is movably mounted on the front region 103. For example, hinges or joints can be arranged in the front compartment, on which the protective flap 111 is mounted. The protective flap 111 can thus advantageously be displaced from the protective position into an open position in which access to an interior of the front compartment 109 is enabled.

Furthermore a decorative flap 113 is provided. FIG. 1 shows the decorative flap 113 in an extended position in which access to the protective flap 111 and also access to the interior of the front compartment 109 is enabled if additionally the protective flap 111 is still in its open position. The decorative flap 113 is movably mounted. For example, hinges or joints can be arranged in the front region, on which the decorative flap 113 is suspended or mounted. The decorative flap 113 can thus be displaced or moved into a position in which the decorative flap 113 hides the protective flap 111 at least partially, in particular completely. This is particularly the case when a user is looking at the front side 105.

The decorative flap 113 has a lower degree of rigidity than the protective flap 111. The decorative flap 113 is thus advantageously optimized as regards design and manufacturing costs, but not as regards a protective function. The protective flap 111 assumes the protective function.

In one embodiment (not shown) the rail vehicle 101 is a multiple unit or a locomotive.

In embodiments (not shown) one or more device compartments can be provided in addition to or instead of the front compartment 109, which similarly to the front compartment 109 are each provided with a protective flap and a decorative flap.

The inventive idea in particular thus comprises separating the functions of design and protection (brought about by an increased rigidity) in terms of elements, wherein the element with the protective or rigidity function is hidden at least partially, in particular completely, by the element with the design function. The element with the rigidity or protective function can be referred to as an impact shield. The element with the design function can be referred to as a design flap. Both elements are arranged or configured or embodied so that in particular they can be pivoted and/or rotated and/or lifted out and/or removed, in order further to enable simple and quick access to the components lying behind these elements, in particular the device or devices which are located in the device compartment, in particular the front compartment.

The inventive idea thus consists in particular in splitting the two functionalities of design and protection (rigidity) between two components, here the two elements, which runs counter to the basic intent in design of combining functionalities. By combining the two functionalities a massive front flap stiffened (for protection of the components lying behind it) at great cost would result, said front flap often being exposed to minor to major damage from wildlife. Each of said incidents of damage from wildlife (except for the smallest wildlife) would then require a likewise once again expensive repair streamlined for visual appearance or a replacement of the front flap.

Thanks to the division between two elements it is advantageously possible to optimize the decorative or design flap, which will be damaged in almost every collision, as regards design and replacement costs, as it were as a "disposable part". In contrast, the impact shield or the protective flap need be repaired either simply and crudely (but not in terms of visual appearance) up to a moderate level of damage or (in the case of smaller dents) need not be repaired at all.

In summary, the invention in particular has the advantage that repair times and downtimes are reduced. Corresponding costs are advantageously reduced. Nevertheless, in the case of an accident it is possible to continue a journey as quickly as possible, at least as far as the next depot. Nevertheless, an optimum protective effect against more minor and moderate instances of damage (for example accidents involving wildlife or rockfalls) to devices that are located in the device compartment, in particular the front compartment, is enabled. The device is for example an air-conditioning system or an air-conditioning device.

Although the invention has been illustrated and described in greater detail by the preferred exemplary embodiments, the invention is not limited by the disclosed examples and other variations can be derived herefrom by the person skilled in the art without departing from the scope of protection of the invention.

The invention claimed is:

1. A rail vehicle, comprising:

a device compartment for accommodating a device;

a protective flap for protecting said device compartment, said protective flap having a hinge or joint arranged in said device compartment for movably mounting said protective flap and opening said device compartment; and a decorative flap at least partially covering said protective flap, said decorative flap having a lower degree of rigidity than said protective flap, said decorative flap having a further hinge or a further joint arranged in a front region of the rail vehicle for movably mounting said decorative flap and selectively covering and uncovering said protective flap.

2. The rail vehicle according to claim 1, wherein at least one of said protective flap or said decorative flap is detachably disposed.

3. The rail vehicle according to claim 1, which further comprises a rail vehicle exterior being formed at least partially by said decorative flap in a condition at least partially covering said protective flap.

4. The rail vehicle according to claim 3, wherein said rail vehicle exterior forms a front side of the rail vehicle.

5. The rail vehicle according to claim 4, which further comprises an anti-penetration wall, an under frame and a front window formed above said under frame, said device compartment being a front compartment disposed above said under frame, underneath said front window and between said front side and said anti-penetration wall.

6. The rail vehicle according to claim 1, wherein the rail vehicle is a multiple unit or a locomotive.

7. The rail vehicle according to claim 1, wherein said decorative flap completely covers said protective flap.

8. A rail vehicle, comprising:

a front side having a device compartment for accommodating a device, said device compartment having an opening for access to said device compartment;

a protective flap covering said opening and protecting said device compartment, said protective flap having a forward facing surface, said protective flap having a hinge or joint arranged in said device compartment for movably mounting said protective flap and opening said device compartment; and a decorative flap having a forward facing surface extending substantially coextensively with said protective flap forward facing surface for covering said protective flap in a covering position thereof, said decorative flap having a lower degree of rigidity than said protective flap, said decorative flap having a further hinge or a further joint arranged in a front region of the rail vehicle for movably mounting said decorative flap and selectively covering and uncovering said protective flap.

9. A rail vehicle, comprising:

a front side having a device compartment for accommodating a device, said device compartment having an opening for access to said device compartment;

a protective flap for covering said opening and protecting said device compartment; and a decorative flap secured directly on said protective flap and being displaceable therewith for providing access to said device compartment, said decorative flap having a lower degree of rigidity than said protective flap, said decorative flap being configured for moving to an extended position with said protective flap in an open position and said protective flap spaced from said decorative flap.

* * * * *